US005859582A

United States Patent [19]

Yuen

[11] Patent Number: 5,859,582

[45] Date of Patent: Jan. 12, 1999

[54] PERSONAL SECURITY ALARM WITH TWIN LIGHTS

[75] Inventor: John Se-Kit Yuen, Kowloon, Hong Kong

[73] Assignee: John Manufacturing Limited, Kowloon, Hong Kong

[21] Appl. No.: 590,523

[22] Filed: Jan. 24, 1996

[51] Int. Cl.[6] ..... G08B 23/00

[52] U.S. Cl. ..... 340/326; 340/321; 340/693; 362/184; 116/3; 116/DIG. 44

[58] Field of Search ..... 340/321, 326, 340/546, 548, 693, 573, 574; 362/102, 184, 197; 116/DIG. 44, 3

[56] References Cited

U.S. PATENT DOCUMENTS

| | | | |
|---|---|---|---|
| 2,329,556 | 9/1943 | Raabe | 362/99 |
| 2,581,129 | 1/1952 | Muldoon | 362/184 |
| 3,030,497 | 4/1962 | Cheng | 340/321 |
| 3,248,723 | 4/1966 | Miette | 340/321 |
| 4,716,402 | 12/1987 | Francis | 340/321 |
| 4,835,665 | 5/1989 | Kao | 362/184 |
| 5,077,644 | 12/1991 | Schaller et al. | 362/184 |
| 5,217,297 | 6/1993 | Yuen | 362/184 |
| 5,558,430 | 9/1996 | Booty, Jr. | 362/184 |

FOREIGN PATENT DOCUMENTS 2118290 10/1983 United Kingdom .

*Primary Examiner*—Edward Lefkowitz
*Attorney, Agent, or Firm*—Fay, Sharpe, Beall, Fagan, Minnich & McKee

[57] ABSTRACT

A personal security alarm device includes a flashlight having a main housing with a bulb and reflector, a battery compartment and an actuation switch. A sub-housing is pivotally mounted in an L-shaped cut out portion at the lower front end of the main housing. An audible alarm is mounted in the main housing and is energized by pulling a handle to extract a contact pin from the housing and close a pair of electrical contacts.

5 Claims, 3 Drawing Sheets

PERSONAL SECURITY ALARM WITH TWIN LIGHTS

FIELD OF THE INVENTION

The invention relates to a personal security alarm device with twin lights and an audible alarm.

BACKGROUND OF THE INVENTION

Flashlights are widely used in situations where there is insufficient ambient light to perform a required activity. However with some activities, particularly walking, it is desirable to see not only forwards to ensure that there is no obstruction to be collided with but also downwards so that it can be ensured that there are no low level obstructions to trip over. Providing both forward and downward illumination can be done with a wide angle reflector flashlight but this can dissipate the brilliance of the illumination such that it is ineffective in any direction.

Personal alarms have been proposed to be tripped by the user if the user considers there is a risk of assault, however such alarms must either be concealed in which case there may be difficulty in readily actuating the alarm if the assault occurs unexpectedly or if carried openly, the assailant may target the personal alarm initially and remove it from the user before the alarm can be tripped.

SUMMARY OF THE INVENTION

According to the invention there is provided a personal security alarm with twin lights comprising a flashlight comprising a main housing having a fixed bulb and reflector mounted therein, a battery compartment and an actuation switch, a sub-housing pivotally mounted on said housing, said sub-housing incorporating a bulb and a reflector with said bulb coupled via said actuation switch to battery contacts of said battery compartment, and an audible alarm contained within said housing and connected, via a second actuation switch, to said contacts of said battery compartment, a flexible handle coupled to an electrical contact member which is engageable in an aperture in said housing, said second actuation switch being closed upon said contact member coupled to said flexible handle being pulled out of said aperture in said housing.

Preferably said sub-housing is pivotal through up to 90° with respect to said main housing from a position in which said bulb and reflector of said housing and aid bulb and reflector of said sub-housing are aligned to give parallel beams to a position in which the beam from said bulb and reflector of said sub-housing is at 90° to the beam from said bulb and reflector of said main housing.

Advantageously said housing is formed as a generally rectangular member with a transverse aperture therethrough thereby defining an upper handle portion, in which upper handle portion said actuation switch is incorporated, a forward portion mounting said bulb and reflector and said sub-housing, a lower portion incorporating said battery compartment and a rear portion incorporating said audible alarm, said aperture to receive said contact member of said flexible handle being provided extending in a vertical direction at an upper rearward part of said housing.

BRIEF DESCRIPTION OF THE DRAWINGS

The invention is diagrammatically illustrated by way of example in the accompanying drawings, in which.

DETAILED DESCRIPTION OF THE PREFERRED EMBODIMENT

Figure 1:
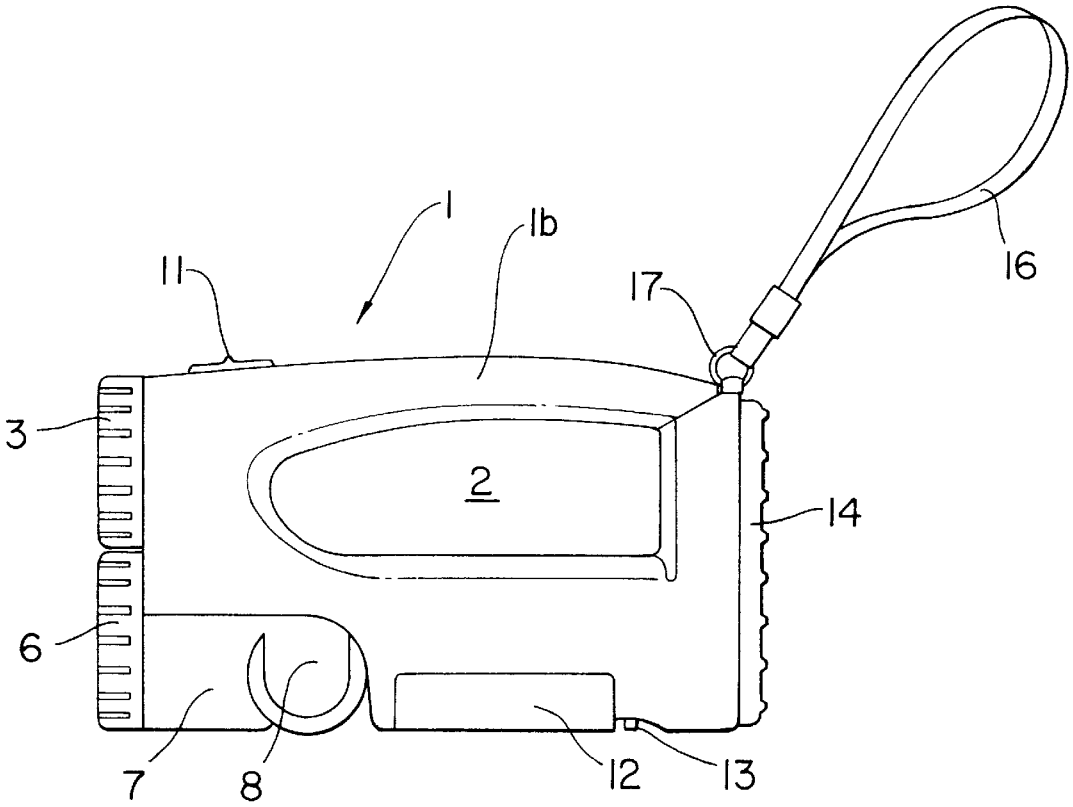
FIG. 1 is a side view of a personal security alarm with twin lights according to the invention shown in a configuration to give two forwardly directed parallel beams of light.
Figure 2:
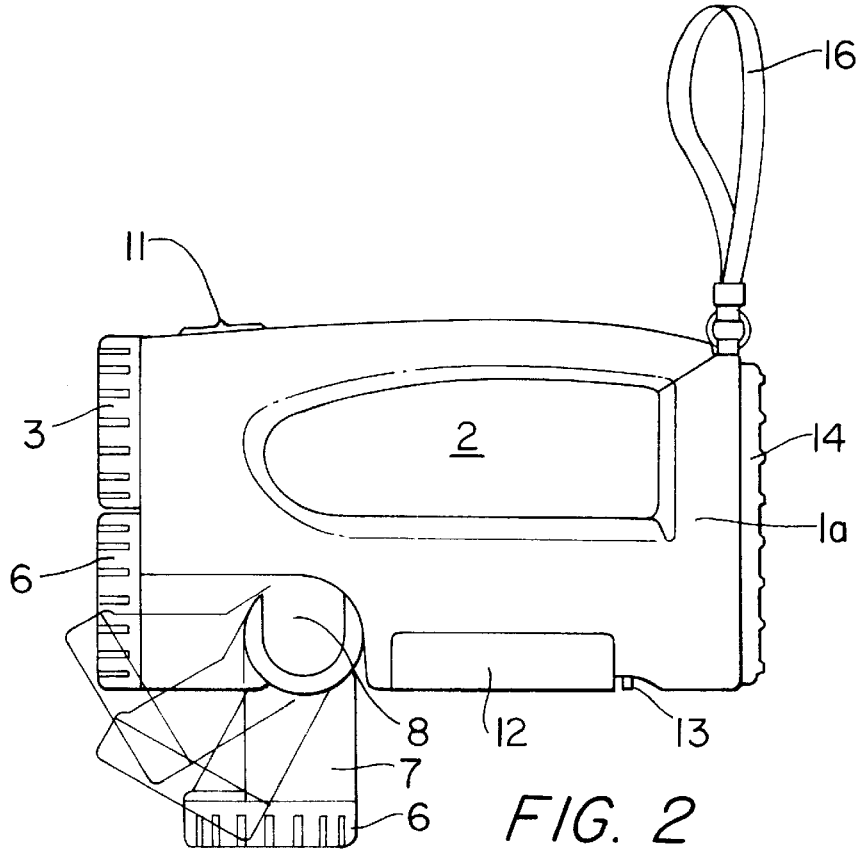
FIG. 2 is a view similar to FIG. 1 but with a sub-housing shown pivoted through 90° with respect to a main housing so that a beam of a light from the sub-housing is directed at right angles from that of the main housing.
Figure 3:
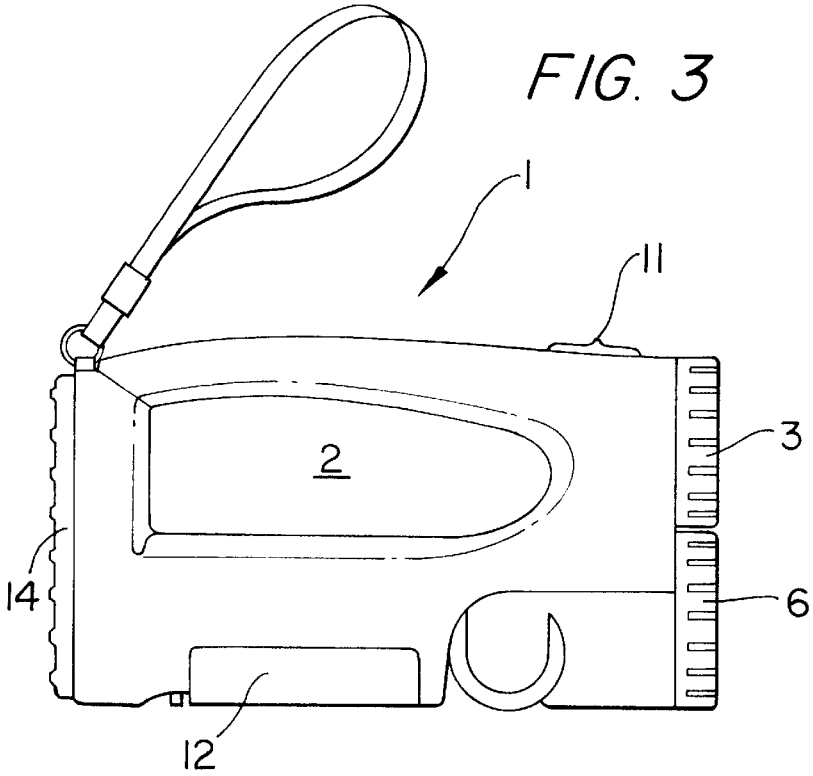
FIG. 3 is a view similar to FIG. 1 but taken from an opposite side of the housing.
Figure 4:
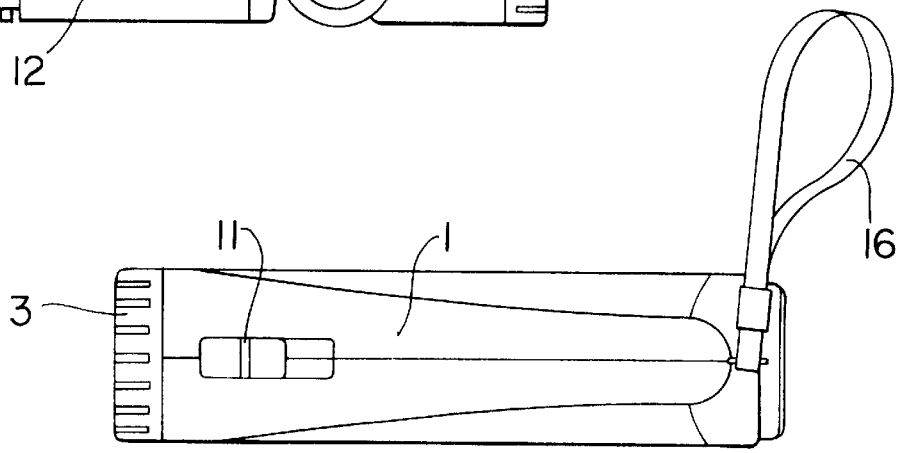
FIG. 4 is a plan view corresponding to FIG. 1.
Figure 5:
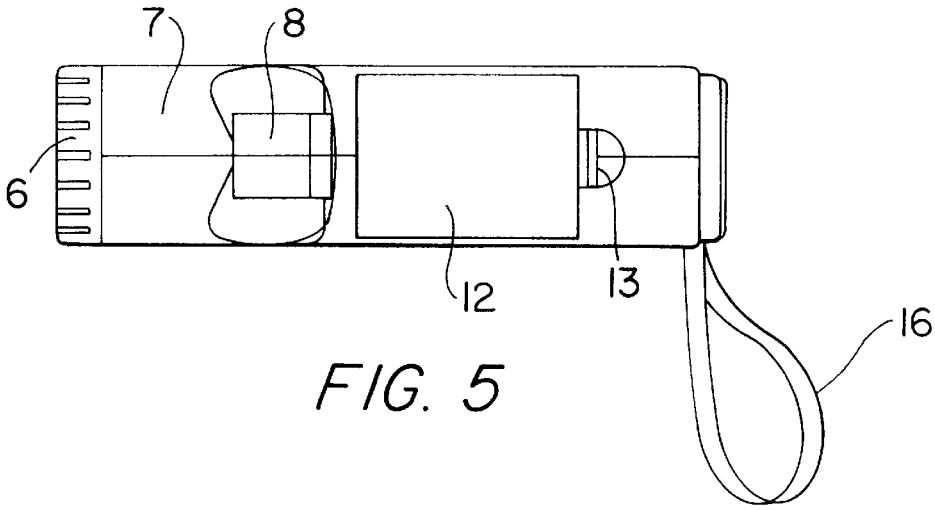
FIG. 5 is an underneath plan view corresponding to FIG. 1.
Figure 6:
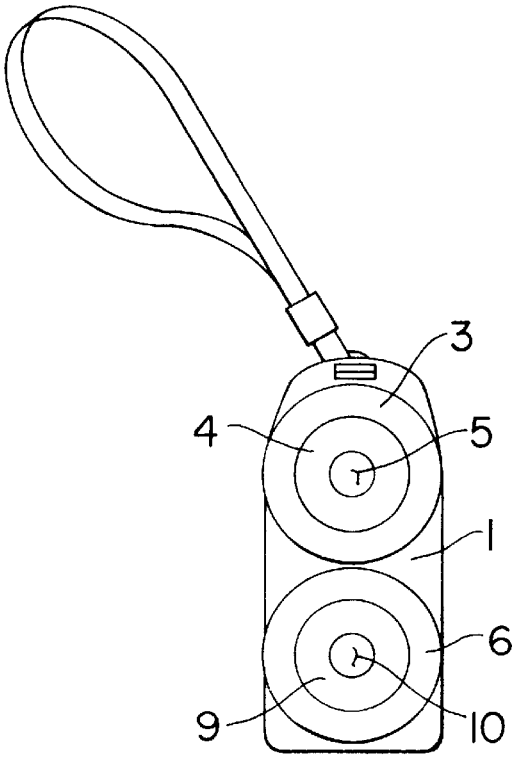
FIG. 6 is a front view corresponding to FIG. 1.
Figure 7:
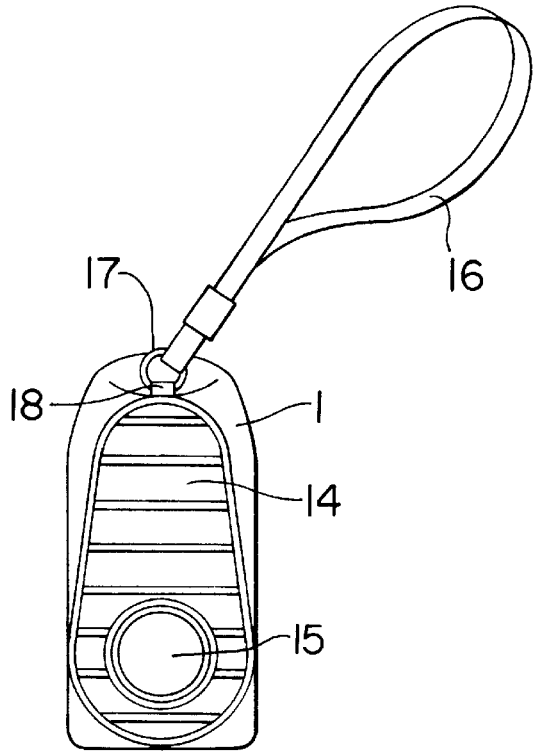
FIG. 7 is a rear view corresponding to FIG. 1.
Figure 8:
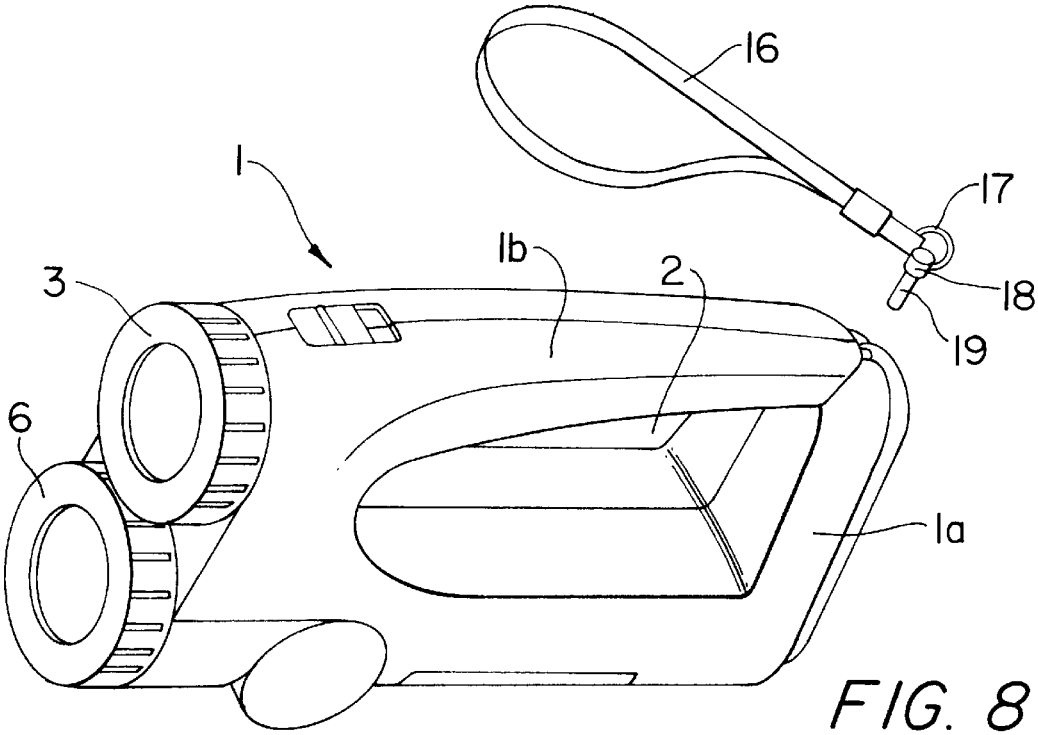
FIG. 8 is a perspective view generally corresponding to FIG. 1 but showing a contact member disengaged.

Referring to the drawings in which like components are referenced throughout by like reference numerals, a personal security alarm with twin lights has a main housing 1 of moulded plastics formed to define a lateral aperture 2 therethrough. At an upper front end of the housing, a first bezel 3 is connected to the housing by a bayonet connection and retains a reflector 4 and bulb 5, shown only in FIG. 6. Below the first bezel 3 a second bezel 6 is secured by a bayonet connection to a sub-housing 7 which is pivotally mounted at an inner end of an L-shaped cut out portion at a lower front end of the main housing 1, by a pivot 8 whereby the front end of the sub-housing faces outwardly without any obstruction in front thereof. As shown in FIG. 6, the second bezel 6 retains a reflector 9 and a bulb 10. The sub-housing 7 is pivotable about the pivot 8 from the position shown in FIG. 1 90° to the position shown in FIG. 2 and can be stopped at any angle therebetween. At the upper part of the handle an actuation slide switch 11 is provided.

Within the housing 1 and to the rear of the sub-housing 7, a battery compartment is provided closed by a battery compartment cover 12 secured by a latch 13.

In a rearward part 1*a* of the housing 1 an audible alarm 14 is encased, the audible alarm having a sounder 15. A flexible loop handle 16 is coupled to a ring 17 which passes through the head 18 of a contact pin 19 which, in the engaged position shown in FIGS. 1 to 7 of the drawings, maintains a pair of electrical contacts (not shown) isolated from another. If a tug is provided between the housing 1 and the handle 16, the pin 19 will be withdrawn from the housing 1 thereby allowing the pair of electrical contacts to engage one another.

Provided within the housing and therefore not visible in the drawings is wiring which connects the bulbs 5 and 10 via the actuation switch 11 to contacts in the battery compartment which will make contact with batteries inserted into the battery compartment. Further wiring connects the alarm 14 by way of the pair of contacts which are normally separated by the pin 19 to the battery contacts referred to above but in this case not via the actuation switch 11.

The actuation switch 11 is a four position switch comprising an off position, a first on position in which the bulb 5 is illuminated, a second on position in which the bulb 10 is illuminated and a third on position in which both the bulb 5 and the bulb 10 are illuminated.

In use with the loop handle 16 around the wrist of the user and the user gripping an upper handle part 1*b* of the housing with the fingers of the hand extending through the aperture 2, the user merely appears to be carrying an ordinary flashlight. Light from the bulb 5 and/or the bulb 10 in the position of FIGS. 1 and 3, can be used to provide forward illumination. If the user is concerned that the ground over which he is walking may not be even, ie it may have low level obstructions thereon, then the sub-housing 7 can be pivoted about the pivot 8 to any position up to the position of FIG. 2 and the bulbs 5 and 10 both illuminated so as to provide not only a forwardly directed light but a downwardly directed light. If the user feels threatened by an assailant, he has only to release the handle portion 1*b* while retaining the loop handle 16 and the weight of the housing 1 with the batteries contained in the battery compartment will be sufficient to withdraw the pin 19 from the housing 1 thereby closing the pair of contacts and energising the alarm 14 to cause the sounder 15 to issue an audible alarm.

What is claimed is:

1. A personal security alarm device comprising:

a flashlight having a main housing with a generally L-shaped cut out portion at a lower front end portion thereof;

a sub-housing pivotally mounted at an inner end of said L-shaped cut out portion whereby a front end of said sub-housing normally faces outwardly without any obstruction in front thereof;

a first bulb and reflector mounted in an upper front end portion of said main housing;

a second bulb and reflector mounted in the front end of said sub-housing;

a battery compartment having battery contacts therein in said main housing;

a first actuation switch mounted on said main housing and connected to said battery contacts and said first and second bulbs for selectively energizing either or both of said first and second bulbs;

an audible alarm mounted in said main housing;

a second actuation switch connected to said battery contacts and said audible alarm; and a removable electrical contact member engagable in an aperture in said main housing, said second actuation switch being closed upon said electrical contact member being removed from said aperture.

2. A personal security alarm device as claimed in claim 1, wherein said sub-housing is pivotal through up to 90° with respect to said main housing from a position in which said first bulb and reflector of said main housing and said second bulb and reflector of said sub-housing are aligned to give parallel beams to a position in which the beam from said second bulb and reflector of said sub-housing is at 90° to the beam from said first bulb and reflector of said main housing.

3. A personal security alarm device as claimed in claim 1, wherein said main housing comprises a generally rectangular member with a transverse aperture therethrough thereby defining an upper handle portion, in which upper handle portion said first actuation switch is incorporated, a forward portion mounting said first bulb and reflector and said sub-housing, a lower portion incorporating said battery compartment and a rear portion incorporating said audible alarm, said aperture to receive said contact member being provided extending in a vertical direction at an upper rearward part of said main housing.

4. A personal security alarm device as claimed in claim 1, wherein a flexible handle is coupled to said electrical contact member.

5. A personal security alarm device as claimed in claim 1, wherein said sub-housing is pivotal through up to 90° with respect to said main housing from a position in which said first bulb and reflector of said main housing and said second bulb and reflector of said sub-housing are aligned to give parallel beams to a position in which the beam from said second bulb and reflector of said sub-housing is at 90° to the beam from said first bulb and reflector of said main housing and wherein said main housing comprises a generally rectangular member with a transverse aperture therethrough thereby defining an upper handle portion, in which upper handle portion said first actuation switch is incorporated, a forward portion mounting said first bulb and reflector and said sub-housing, a lower portion incorporating said battery compartment and a rear portion incorporating said audible alarm, said aperture to receive said contact member being provided extending in a vertical direction at an upper rearward part of said main housing.

* * * * *